United States Patent [19]

Sheinberg

[11] Patent Number: 4,626,281

[45] **Date of Patent: * Dec. 2, 1986**

[54] HARD METAL COMPOSITION

[75] Inventor: Haskell Sheinberg, Los Alamos, N. Mex.

[73] Assignee: The United States of America as represented by the United States Department of Energy, Washington, D.C.

[ * ] Notice: The portion of the term of this patent subsequent to Aug. 23, 2000 has been disclaimed.

[21] Appl. No.: 731,616

[22] Filed: May 7, 1985

Related U.S. Application Data

[63] Continuation of Ser. No. 517,536, Jul. 26, 1983, abandoned.

[51] Int. Cl.[4] ..... C22C 29/00

[52] U.S. Cl. ..... 75/238; 75/245; 75/254

[58] Field of Search ..... 75/238, 245, 240, 254, 75/255; 419/17, 48, 12

[56] References Cited

U.S. PATENT DOCUMENTS

| | | | |
|---|---|---|---|
| Re. 21,730 | 2/1941 | Schwarzkopf | 75/238 |
| 2,200,258 | 5/1940 | Boyer | 75/238 |
| 2,916,809 | 12/1959 | Schell et al. | 75/248 |
| 3,367,398 | 2/1968 | Riley et al. | 75/262 |
| 3,386,812 | 6/1968 | Sheinberg | 75/238 |
| 3,672,936 | 6/1972 | Ehrenrich | 428/408 |
| 4,212,670 | 7/1980 | Shveikin et al. | 75/238 |
| 4,400,213 | 8/1983 | Sheinberg | 75/238 |

OTHER PUBLICATIONS

Brookes, World Dictionary and Handbook of Hard Metals, 3rd Ed., 1982, published by Engineers' Digest Ltd. & International Carbide Data, pp. 1 to 57.

*Primary Examiner*—Stephen J. Lechert, Jr.
*Assistant Examiner*—Anne Brookes
*Attorney, Agent, or Firm*—Joseph M. Hageman; Paul D. Gaetjens; Judson R. Hightower

[57] ABSTRACT

A composition of matter having a Rockwell A hardness of at least 85 is formed from a precursor mixture comprising between 3 and 10 weight percent boron carbide and the remainder a metal mixture comprising from 70 to 90 percent tungsten or molybdenum, with the remainder of the metal mixture comprising nickel and iron or a mixture thereof. The composition has a relatively low density of between 7 to 14 g/cc. The precursor is preferably hot pressed to yield a composition having greater than 100% of theoretical density.

6 Claims, No Drawings

HARD METAL COMPOSITION

This invention is the result of a contract with the Department of Energy (Contract No. W-7405-ENG-36).

This is a continuation of application Ser. No. 517,536 filed July 26, 1983, abandoned.

BACKGROUND OF THE INVENTION

The invention described herein is generally related to hard metal compositions, also known in the trade as hardmetals, such as are used in machine tools, rock drilling bits and in other applications requiring metal components having high hardness. More particularly, this invention is related to the tungsten and molybdenum boride-carbide family of hardmetals.

Tungsten carbide is a well known hard material, having a hardness value of 92 to 96 as measured by the Rockwell A hardness test. However, pure tungsten carbide is too brittle for use in most applications. Accordingly, it is well known to combine tungsten carbide with a relatively soft binder metal, such as cobalt, nickel, iron or a mixture thereof, to make a hard composition having both high hardness and high fracture toughness. The compositions utilizing cobalt as the binder are generally recognized as being superior in the characteristics which are important in practical applications, primarily hardness and toughness, and for this reason the cobalt-tungsten carbides are widely used in rock drilling bits, tool bits, tire studs and similar applications. Cobalt, however, is a metal which is almost exclusively imported into the United States, with the result that the availability and price of cobalt are unstable and the price is subject to wide and unpredictable fluctuations.

Boron carbide is second only to diamond and cubic boron nitride in hardness. However, its practical utility is limited by its high brittleness and virtual lack of elongation. Some efforts have been made to react boron carbide with various metals to form metal carbide/metal boride compositions which are both hard and resistant to fracture, so as to render them desirable as machine tool bits and the like. For example, U.S. Pat. No. 3,386,812 discloses a nickel-boron carbide composition. More important in this regard, however, is the applicant's own previous work, which is disclosed and claimed in the U.S. Pat. No. 4,400,213. In that application there is disclosed the applicant's development of a hard composition which consists generally of the hot-pressed reaction product of either tungsten or molybdenum mixed with boron carbide and a binder of nickel and/or iron. The metallic component of that composition (i.e., the non-boron carbide component), as disclosed and claimed in the referenced application, contains tungsten or molybdenum in a concentration of at least 90 percent by weight. Consequently, the hard composition has a relatively high density, on the order of 15 to 16 g/cc. Although such a high density is of no consequence in many applications, and in fact constitutes an advantage in some applications, there are other applications in which it would be desirable to employ similar hard metal compositions having a relatively lower density. Such applications include, for example, machine tools having high speed moving tool bits, hard metal components used in aircraft, hard metal components used in munitions projectiles, and tire studs.

SUMMARY OF THE INVENTION

Accordingly, it is an object and purpose of the present invention to provide an improved hard metal composition.

It is also an object and purpose of the invention to provide a hard metal composition having a low density, and, more particularly, a lower density than that of the hard composition of matter disclosed and claimed in the applicant's previous patent application, referenced above.

It is also an object and purpose to provide a hard metal composition of improved fracture toughness.

It is also an object of the present invention to provide a cobalt-free hard metal composition.

To achieve the foregoing and other objects, and in accordance with the purposes of the present invention, as embodied and broadly described herein, the present invention provides a hard composition of matter which comprises the hot-pressed reaction product of a boron carbide component and a metal mixture. The boron carbide component consists essentially of boron carbide ($B_4C$) or, alternatively, any substantially stoichiometric equivalent mixture of boron and carbon. The metal mixture includes a first metal component and a second metal component. The first metal component is tungsten, molybdenum or a mixture thereof. When the first metal component is tungsten, the boron carbide component comprises between approximately 3 and 6 percent by weight of the composition. When the first metal component is molybdenum, the boron carbide component comprises between approximately 6 and 10 percent by weight of the composition. The tungsten and molybdenum of the first metal component are interchangeable and mutually substitutable on a mole-for-mole basis, with the foregoing percentages being adjusted on a pro rata basis in the case where there is a mixture of tungsten and molybdenum comprising the first metal component.

The second metal component of the metal mixture is nickel or iron or a mixture thereof. This component is present in an amount comprising the remainder of the composition. When the first metal component is tungsten, the metal mixture preferably consists of from 10 to 21 percent by weight nickel and from 0 to 9 percent by weight iron. When the first metal component is molybdenum, the metal mixture preferably consists of between 9 and 20 percent nickel and from 0 to 9 percent iron. As with the boron carbide component discussed above, these percentages are adjustable on a pro rata basis when the first metal component consists of a mixture of tungsten and molybdenum.

The present invention essentially represents an extension of the applicant's previous work, disclosed and claimed in the above referenced patent application, in which the applicant determined that the concentration of the tungsten/molybdenum component of the metallic mixture of the hard metal composition could be as low as 90 weight percent. With the present invention, the applicant has determined that the tungsten/molybdenum component can be even further reduced, to as low as 70 weight percent of the metal mixture in the case of tungsten or 72 percent in the case of molybdenum, with no appreciable reduction in hardness. This is considered to be a surprising and unpredicted result, with the important consequence that the hard composition of matter can be made to have a considerably lower density and weight with no decrease in hardness.

These and other aspects of the invention will be more fully apparent upon consideration of the more detailed description of the invention set forth below.

DETAILED DESCRIPTION OF THE INVENTION

The hard metal composition of the present invention is made from a powdered precursor mixture which includes boron carbide, a metal binder consisting of powdered iron, nickel, or a mixture thereof, and powdered tungsten or molybdenum or a mixture thereof. During sintering of the precursor mixture the iron/-nickel binder phase dissolves some of the tungsten/-molybdenum phase to become an alloy of nickel, iron and tungsten (or molybdenum). Also, the constituents of the binder phase are known to react to a limited extent with the boron carbide to form small amounts of iron and nickel carbides as well as iron and nickel borides, and probably also dissolve a limited amount of boron carbide as such. However, it is nevertheless thought that the iron/nickel component of the mixture functions primarily in its known capacity as a binder phase.

It is also known that tungsten reacts in the liquid phase with the boron carbide during sintering to form tungsten carbide and tungsten boride compounds, both of which are thought to occur in several stoichiometric species. Tungsten, for example, is known to form WC, $W_2C$ and minor concentrations of other compounds. Molybdenum likewise reacts with boron carbide to form various indefinitely characterized molybdenum carbide and molybdenum boride species.

Table 1 sets forth compositions, measured hardness values and densities for ten samples which were prepared by hot pressing from powders, as further described below.

In Table 1, the weight percentages of the various metals which are presented in brackets represent the weight percent of each particular metal with respect to the total metal content of the sample; that is, excluding the boron carbide component. The weight percent of total metal in the sample is given under the column titled "Total Metal". Thus, for example, the first sample, identified by the run number PA-6, contains 5% by weight boron carbide, with the remaining 95% of the sample consisting of the metals tungsten, nickel and iron. Of the 95% of the sample which consists of these three metals, the proportions of tungsten, nickel and iron are 70%, 21% and 9% by weight, respectively.

TABLE I*

| Run No. | Total Metal | W | Mo | Ni | Fe | $B_4C$ | $R_A$ Hardness** | Theoretical Density (g/cc) | Measured Density (g/cc) |
|---|---|---|---|---|---|---|---|---|---|
| PA-6 | 95.00 | [70.00 | — | 21.0 | 9.00] | 5.00 | 89.4, 90.2 | 11.48 | 13.75 |
| PA-5 | 95.50 | [75.00 | — | 17.50 | 7.50] | 4.50 | 87.3, 87.0 | 12.06 | 13.58 |
| PA-2 | 96.00 | [80.00 | — | 14.00 | 6.00] | 4.00 | 89.2, 89.5 | 12.80 | 13.98 |
| PA-1 | 96.50 | [85.00 | — | 10.50 | 4.50] | 3.50 | 89.2, 89.8 | 13.64 | 14.57 |
| PA-9 | 96.50 | [85.00 | — | 15.00 | —] | 3.50 | 89.7, 87.0 | 13.76 | 14.48 |
| PA-8 | 90.90 | [— | 72.00 | 19.60 | 8.40 | 9.10 | 88.6, 89.1 | 7.70 | 8.21 |
| PA-7 | 91.80 | [— | 77.00 | 16.10 | 6.90] | 8.20 | 91.0, 89.1 | 7.90 | 8.59 |
| PA-4 | 92.55 | [— | 80.48 | 13.66 | 5.86] | 7.45 | 89.4, 89.9 | 8.08 | 8.63 |
| PA-3 | 93.46 | [— | 87.10 | 9.02 | 3.87] | 6.54 | 91.0, 90.8 | 8.34 | 8.77 |
| PA-10 | 93.46 | [— | 87.11 | 12.89 | —] | 6.54 | 86.9, 90.9 | 8.39 | 8.77 |

*All figures represent weight percent.
**$R_A$ values are given for the opposite ends of each sample; each value is an average of five actual measurements.

The samples presented in Table 1 were prepared from dry powdered precursor mixtures of the fine grained boron carbide and powders of the elemental metals. The precursor mixtures were loaded into graphite dies and hot pressed at a temperature of 1460° C. and a pressure 21 MPa to form pressed cylinders approximately 20 mm long and 31.8 mm in diameter. As indicated in Table 1 the measured densities of the pressed cylinders were each in excess of 100% of theoretical density based on simple mixtures of the blended constituents.

One end of each cylinder was reduced by 0.5 mm and both ends were then ground flat. Rockwell A hardness tests were then conducted on the opposite ends of each cylinder; the results are presented in Table 1.

Another set of ten samples, having the same compositions as those set forth in Table 1, and made from the same precursor mixtures, were prepared by the method of cold fluid isostatic pressing followed by sintering at atmospheric pressure in hydrogen at 1460°-1470° C. Sintering was conducted with a heating rate of 300° C./hour to minimize solid state reactions. This method of preparation was tried because it represents a more economical approach than the hot pressing method described above. However, the results from the cold pressing/sintering method were not as satisfactory as those from the hot pressing method. Only two of the cold-pressed samples, those represented by run numbers PA-4 and PA-10, were pressed to greater than 100% of theoretical density. One of these samples, PA-9 was determined to have a Rockwell A hardness of 88.6.

The actual chemical nature of hard metal composition of the present invention is not well known, apart from its bulk chemical composition. It is thought that the composition includes mixed metal carbides, metal borides and metal boro-carbides. It is speculated that the principal contribution to hardness is due to the formation of tungsten or molybdenum borides, boro-carbides and carbides, but further work is necessary to confirm this.

A major consequence of reducing the tungsten/-molybdenum content of the composition is a reduction in the density of the composition. This is a result of the large difference in densities between, for example, tungsten (19.3 g/cc) and nickel (8.9 g/cc). As indicated in Table 1, the tungsten series of compositions ranges in density from approximately 13.5 to 14.5 g/cc, and the molybdenum series of compositions ranges in density from approximately 8.2 to 8.8 g/cc. With respect to the latter series, it is noted that the densities of the molybdenum compositions are approximately half that of the tungsten carbide composition currently used in tool bits and tire studs.

The foregoing description of preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention as defined by the claims appended hereto.

What is claimed is:

1. A hard composition of matter having a Rockwell A hardness value of at least approximately 85, comprising the compressed and densified reaction product of:

a minor amount of a boron carbide component selected from the group consisting of (a) boron carbide and (b) boron and carbon, the boron and carbon being present in amounts sufficient to form boron carbide in situ, wherein said boron carbide component consists essentially of $B_4C$;

a major amount of a metal mixture consisting essentially of:

(a) a first metal component selected from the group consisting of tungsten and molybdenum and mixtures thereof, and (b) a second metal component selected from the group consisting of nickel and iron and mixtures thereof;

wherein said minor amount of said boron carbide component is between 3% and 6% by weight of said composition of matter when said first metal component is tungsten, said minor amount of said boron carbide component is between 6% and 10% by weight of said composition when said first metal component is molybdenum, and said boron carbide component is between 3% and 10% when said first metal component is a mixture of tungsten and molybdenum, with the remainder of the composition being formed of said metal mixture; and wherein said first metal component is from 70% to less than about 90% by weight of said metal mixture when said first metal component is tungsten, and wherein said first metal component is from 72% to less than about 90% by weight of said metal mixture when said first metal component is molybdenum; with the remainder of said metal mixture in each case being formed of said second metal component, and wherein for hard compositions of matter with similar Rockwell A hardness properties when one unmixed said first metal component is totally substituted for the other unmixed said first metal component, the ratio of the moles of the unmixed first metal component to moles of boron carbide is held constant; and wherein for hard compositions of matter with similar Rockwell A hardness properties when said first metal component is a mixture of tungsten and molybdenum, the sum of the number of moles of tungsten and molybdenum is held constant with respect to the number of moles of boron carbide.

2. The composition of matter defined in claim 1 wherein said second metal component of said metal mixture consists of nickel in an amount of between 10% to 21% by weight of said metal mixture, and iron in an amount of between 0% and 9% of said metal mixture, and with the total of said iron and nickel amounts being not greater than 30% by weight of said metal mixture, when said first metal component is tungsten; and wherein said second metal component consists of nickel in an amount of between 9% and 20% by weight of said metal mixture, and iron in an amount of between 0% and 9% of said metal mixture, and with the total of said nickel and iron amounts being not greater than 28% by weight of said metal mixture, when said first metal component is molybdenum.

3. The composition of matter defined in claim 2 wherein said second metal component of said metal mixture consists essentially of nickel.

4. A precursor mixture useful for forming a composition of matter having a Rockwell hardness of at least approximately 85, comprising:

a minor amount of a boron carbide component selected from the group consisting of (a) boron carbide and (b) boron and carbon, the boron and carbon being present in amounts sufficient to form boron carbide in situ, wherein said boron carbide component consists essentially of $B_4C$;

a major amount of a metal mixture consisting essentially of:

(a) a first metal component selected from the group consisting of tungsten and molybdenum and mixtures thereof; and (b) a second metal component selected from the group consisting of nickel and iron and mixtures thereof;

wherein said minor amount of said boron carbide component is between 3% and 6% by weight of said composition of matter when said first metal component is tungsten, said minor amount of said boron carbide component is between 6% and 10% by weight of said composition when said first metal component is molybdenum, and said boron carbide component is between 3% and 10% when said first metal component is a mixture of tungsten and molybdenum, with the remainder of the composition being formed of said metal mixture; and wherein said first metal component is from 70% to less than about 90% by weight of said metal mixture when said first metal component is tungsten, and wherein said first metal component is from 72% to less than about 90% by weight of said metal mixture when said first metal component is molybdenum; with the remainder of said metal mixture in each case being formed of said second metal component, and wherein for hard compositions of matter with similar Rockwell A hardness properties when one unmixed said first metal component is totally substituted for the other unmixed said first metal component, the ratio of the moles of the unmixed first metal component to moles of boron carbide is held constant; and wherein for hard compositions of matter with similar Rockwell A hardness properties when said first metal component is a mixture of tungsten and molybdenum, the sum of the number of moles of tungsten and molybdenum is held constant with respect to the number of moles of boron carbide.

5. The precursor mixture defined in claim 4 wherein said second metal component of said metal mixture consists of nickel in an amount of between 10% to 21% by weight of said metal mixture, and iron in an amount of between 0% and 9% of said metal mixture, and with the total of said nickel and iron amounts being not greater than 30% by weight of said metal mixture, when said first metal component is tungsten; and wherein said second metal component consists of nickel in an amount of between 9% and 20% by weight of said metal mixture, and iron in an amount of between 0% and 9% of said metal mixture, and with the total of said iron and nickel amounts being not greater than 28% by weight of said metal mixture, when said first metal component is molybdenum.

6. The precursor mixture defined in claim 4 wherein said second metal component of said metal mixture consists essentially of nickel.

* * * * *